US007384057B2

(12) United States Patent
Steffen et al.

(10) Patent No.: US 7,384,057 B2
(45) Date of Patent: Jun. 10, 2008

(54) APPARATUS FOR TENSIONING A SKI-TOURING BINDING

(76) Inventors: Oliver Steffen, 2632 Derbyshire Way, North Vancouver, British Columbia (CA) V7H 1R1; James D. Shaw, 727 Crystal Court, North Vancouver, British Columbia (CA) V7R 2B5

( * ) Notice: Subject to any disclaimer, the term of this patent is extended or adjusted under 35 U.S.C. 154(b) by 415 days.

(21) Appl. No.: 11/038,458

(22) Filed: Jan. 21, 2005

(65) Prior Publication Data

US 2005/0212263 A1 Sep. 29, 2005

Related U.S. Application Data

(60) Provisional application No. 60/538,223, filed on Jan. 23, 2004.

(51) Int. Cl.
*A63C 9/06* (2006.01)

(52) U.S. Cl. ..... 280/611; 280/615; 280/619; 280/621; 280/622

(58) Field of Classification Search ..... 280/14.21, 280/14.22, 619–626, 611, 614, 633, 634, 280/615, 617
See application file for complete search history.

(56) References Cited

U.S. PATENT DOCUMENTS 2,116,969 A * 5/1938 Cyr, Jr. ..... 36/117.3
4,140,332 A * 2/1979 Beyl ..... 280/626
5,318,320 A * 6/1994 Ramer ..... 280/614
5,518,264 A 5/1996 Broughton
6,267,403 B1 * 7/2001 Bossin et al. ..... 280/625
6,308,979 B1 * 10/2001 Ludlow ..... 280/615

OTHER PUBLICATIONS

Dr. Telemark; "Rainey Designs Hammerhead"; Jan. 2003; Telmarktips.com.
Untitled document for "V-Cam"; Coutoir Magazine (U.S.A.); Jan. 11, 2004; Couloirmag.com (author unknown).
Dostie, C.; "Linken Telemark Binding"; Couloir Magazine (U.S.A); Oct. 2001; Couloirmag.com.

* cited by examiner

*Primary Examiner*—Christopher P. Ellis
*Assistant Examiner*—Vaughn T Coolman

(57) ABSTRACT

An apparatus for tensioning the cable or bail of a ski-touring binding, a tensioning lever for such apparatus, and a replacement component for the lever are provided. The apparatus provides different tension for walking and for skiing. The lever includes a handle and a pivot for rotational engagement of the lever on the cable or bail. The pivot is located between the handle and a plurality of boot heel holders. The holders are configured such that at least one holder will contact the ski boot heel at a different distance relative to the pivot than another of the holders. The replacement component is removably fixed to the lever and is configured to provide a heel holder surface and to retain a bail or cable in rotational engagement with the lever.

21 Claims, 9 Drawing Sheets

APPARATUS FOR TENSIONING A SKI-TOURING BINDING

CROSS REFERENCE TO RELATED APPLICATIONS

This application claims priority to U.S. provisional patent application 60/538,223 filed Jan. 23, 2004, the content of which is hereby incorporated by reference.

FIELD OF THE INVENTION

This invention relates to ski bindings adapted for use with a flexible ski boot and which allow a heel portion of the boot to lift free of the upper surface of the ski while in use.

BACKGROUND OF THE INVENTION

Cross-country and telemark ski bindings, referred to herein as "touring bindings" are designed for use with a ski boot which is sufficiently flexible near the ball of the user's foot to permit the boot to flex upwards and forwards while the toe of the boot remains fixed on the surface of a ski. This permits the user to perform a relatively normal walking motion while travelling uphill or on flat ground and to lift the heel of the boot from the ski in order to perform a telemark-style turning maneuver. Traditionally, such boot flexibility was provided by the materials from which the ski boot was constructed. For example, a ski boot with a leather upper can be quite flexible. Also, boot soles comprising a combination of leather and rubber are also quite capable of flexing near the ball of the foot. More recently, the uppers and soles of telemark ski boots have been constructed from synthetic plastic materials which are less flexible than leather or rubber. To compensate for the use of synthetic materials, modern telemark boots will typically include a compressible bellows in the upper portion of the boot near the ball of the foot which allows flexing of the boot.

A touring binding will comprise a toe piece adapted to hold the toe of the boot at an appropriate location on the upper surface of the ski while leaving the heel portion of the boot free to rise above the ski surface. Some designs of cross-country bindings provide means such as a clamp or pins for fixably retaining the toe of the boot within the toe piece. However, other designs which lack means for such fixing the toe of a boot in the toe piece make use of a cable, bail, or cable and bail combination which extends around the heel of the boot to provide constant tension whereby the boot is urged forward into the toe piece and is retained. Such cable and/or bail assemblies have also been employed to reduce lateral movement of the heel of the boot and to provide means for biasing the heel of the boot towards the ski surface in order to obtain better control of the ski, particularly during downhill skiing.

Tension is typically provided in the aforementioned cable and/or bail assemblies by one or more springs. For example, the binding may comprise a spring-loaded lever mounted to the ski forward of the toe piece to which a cable assembly is attached. Movement of the lever will shorten the rearward extent of the cable relative to the toe piece thereby tensioning the cable about the heel of the boot. In other versions, the lever may be present elsewhere, for example on or near the heel of the boot. Springs may also be situated elsewhere in the assembly, such as at intermediate coaxial positions in the cable/bail assembly alongside or underneath the boot. Springs employed in such bindings include those which operate while under tension (i.e. the spring is stretched while in use) as well as spring assemblies in which a compressed spring provides a directed force which tensions the cable or bail assembly. Regardless of the nature of the spring(s) or their location in the ski binding, employment of synthetic plastic materials in telemark boots has permitted the use of springs which provide for greater tension without buckling or significantly compressing the boot than springs traditionally used with leather boots. This gives the advantage of greater stability during turning and in other downhill maneuvers.

Upwards and forward flexing of a boot in a touring binding results in the sole of the boot adjacent the ball of the foot lifting from the surface of the ski. Since the cable and/or bail assembly is fixed or hinged at selected points on the toe piece, such upward movement of the boot generally results in increased tension being applied through the cable/bail assembly to the heel of the boot while the boot rises. While this greater tension serves to bias the heel of the boot downwards and thereby provides some stability for certain maneuvers, such an increase in tension must be overcome by the user while walking and travelling uphill. When stronger springs are employed, the user will have to perform greater work in lifting the heel of the boot during walking and uphill travelling motions. Even in bindings designed to minimize the difference in tension while the boot flexes, use of higher tension levels to provide downhill stability will increase the bias of the boot towards the ski surface at all flex positions. This can be disadvantageous while climbing uphill using climbing skins since the bias effect tends to lift the ski from the snow surface as the boot flexes forward. With climbing skins, the user may wish to maximize contact with the snow to reduce backwards slippage.

Traditionally, the heel counter of a ski boot extends rearwards some distance and is separated from the boot upper by a welt. This provides an upward facing ledge extending around the circumference of the upper portion of the heel counter and is often used to engage a ski binding element. This feature is often retained in modem plastic ski boots and is included in the I.S.O. standards for ski boots (e.g. ISO 9523:1990). The welt is often retained as a feature on plastic boots employed for cross-country and telemark purposes, but not always. Nevertheless, all cross-country and telemark boots designed for use with cable/bail assemblies will at least have a lateral groove formed around the circumference of the heel counter of the boot below the level at which the welt typically appears. This groove is typically used for placement and engagement of a cable or bail of a touring binding or for placement of a tensioning lever.

Tensioning levers have been employed for many years to retain a cable and/or bail on the heel of a ski and boot. Such cable and/or bail assemblies with tensioning levers have been found in alpine-style bindings in which the heel is continually retained against the surface of the ski; in alpine-touring bindings in which a rigid boot is retained against a plate or bar hinged at the toe of the boot to the ski surface thereby permitting the rigid boot to rise above the ski surface; and, in touring bindings used with flexible boots. Such tensioning levers have also been employed to retain cable or bail assemblies on the heel of boots in other applications such as the case with "step-in" style crampons which are intended to be attached to the full length of the sole of a mountaineering boot without any tendency for separation of the crampon from the boot sole during use.

Tensioning levers operate on the "over-center" principle. The lever will typically comprise a handle portion opposite a portion shaped to engage or clamp a ledge, groove, or other feature on the heel of the boot (a "boot holder"). The lever is rotationally engaged on the cable or bail at a pivot location situated between the handle and the boot holder. The lever is arranged so that when the boot holder is placed on a boot feature and the lever is rotated by means of the handle (typically upwards), the boot feature will come under clamping engagement while the pivot is displaced from a series of positions which place zero, then high, then moderate tension on the cable. The lever retains the cable on the heel of the boot because in order to reverse rotation of the lever thereby releasing it from the boot, the tension on the cable must pass from the moderate to the high tension positions as the lever again passes "over-center", the boot is released. An example of a modem touring binding which employs a heel tensioning lever is the TARGA™ binding produced by G3 Genuine Guide Gear of North Vancouver, British Columbia, Canada. Another example of such a touring binding is the HAMMERHEAD™ binding produced by Rainey Designs of Wilson, Wyo. U.S.A.

The tensioning lever of the HAMMERHEAD™ binding referenced above is designed to assist the user in locating the lever in the lateral groove of a boot heel. This lever, which has been referred to as having a "beaver tail" design consists of a standard lever handle, boot holder means, and a pivot therebetween. Adjacent the boot holder and extending away from the pivot point opposite the handle is a plate provided as a separate element which is removably attached to the lever by means of a fastener. The binding bail assembly is adjusted so that when the user places a boot into the binding with the heel lever rotated backwards and flat to the ski, the heel of the boot will clear the boot holder portion yet contact the plate. The distance between the plate and the heel holder portion is such that once the boot contacts the plate and the user rotates the lever upwards by pulling on the handle, the heel holder will automatically locate and engage the lateral groove of a standard telemark boot heel. In order for the plate to be effective, it must extend away from the pivot the same distance as the heel holder. A different apparatus with a similar boot locating function is found in the V-CAM™ of Voile Equipment (USA) where the heel tensioning element comprises a semi-circular rocker with a boot holder portion and a plate extending from the pivot as far as the boot holder. Stepping on the plate causes rotation of the rocker which automatically engages the heel holder with the lateral groove of a boot heel.

In the past, users of touring bindings that employ a tensioning lever may have compensated for resistance to boot flexing caused by binding tension during walking and uphill maneuvers by rotating the lever past the "over-center" point, thereby disengaging the boot holder from the boot heel. If the overall length of the cable or bail assembly permitted, a surface on the lever other than that which is adapted to clamp the boot might be loosely engaged with a feature on the boot heel keeping the cable/bail from coming to rest on the ski surface and to some extent, preventing the boot from moving rearwardly. In bindings where the cable or bail assembly is the only means for retaining the boot within the binding, such loose engagement would not prevent the boot from becoming completely detached from the binding when significant forces were exerted by the user (such as when kicking or lifting the ski).

SUMMARY OF THE INVENTION

The inventors herein have realized that a tensioning lever for a ski-touring binding may be significantly improved by providing at least two boot holders, each being sized to contact the heel of the boot at different distances relative to the cable/bail pivot on the lever. A boot holder situated at a greater distance from the pivot will displace the pivot a greater distance when that boot holder is engaged on the heel of the boot as compared to a second boot holder on the lever which displaces the lever to a lesser degree. This improvement has been unappreciated until now despite many years of use of heel tensioning levers on touring bindings. With this invention, the user may now employ one of a plurality of heel holders on the tensioning lever to engage the boot with a tension sufficient to secure the boot in the binding for walking and uphill travel yet subjecting the boot to less tensional force than is preferred for downhill travel and turning maneuvers. The greater tension preferred for downhill travel and turning maneuvers is provided by selectively engaging another boot heel holder on the lever which extends further from the pivot thereby displacing the pivot point of the lever a greater distance from the boot heel when engaged causing greater tension to be exerted on the boot. By simply moving the lever from one position to another, the user may switch from a walking mode which requires less energy to flex the boot to a "downhill" mode in which the boot is held under greater tension.

This invention provides an apparatus for tensioning a cable or bail of a ski-touring binding on a heel of a ski boot, the apparatus comprising a lever including a handle, first and second heel holders, and a pivot for rotational engagement of the lever to said cable or bail, wherein the pivot is located between the handle and said first and second holders, said holders being configured such that the first holder will contact said ski boot heel at a different distance relative to the pivot than the second holder.

This invention also provides a heel tensioning lever for a ski-touring binding, the lever comprising: means for actuating the lever and for contacting a rear portion of a ski boot; rotational means for engagement with a cable or bail of the binding, the rotational means having a rotational center; and a plurality of means for clamping engagement with a heel of a boot sole, each of said clamping means having a surface for contacting cable engagement means on the heel, wherein each contacting surface has a point at a minimum distance to the rotational center with the minimum distance for at least one of said contacting surfaces being less than the minimum distance for another of the contacting surfaces and wherein the clamping means having a lessor minimum distance for its contacting surface will provide lesser tensioning of the cable or bail then clamping means having a greater minimum distance for its contacting surface.

The apparatus or heel tensioning lever of this invention may further comprise a cable or bail of a ski-touring binding as well as a toe piece of a ski-touring binding.

The apparatus or heel tensioning lever of this invention may comprise first and second clamping means or boot heel holders which are spaced apart, each comprising a surface for contacting cable engagement feature or means of a ski boot heel. Such a cable engagement feature or means may be the ledge of a boot heel welt or the lateral groove of a boot heel. Preferably, the clamping means or boot heel holders will be shaped to fit or conform to such a cable engagement feature or means. Preferably, the shape will include a concave surface for contacting the cable engagement feature or means. Preferably, the contact surface will conform to the curvature of a ski boot heel. However, the holder or clamping means may include a plurality of spaced apart surfaces for contacting the boot heel thereby improving contact with the curvature of the boot heel.

The boot heel holders or clamping means are typically spaced apart, preferably at a distance to readily permit one such holder or means to engage the lateral groove of a ski boot heel while permitting another of the holder or means to engage the heel welt upon rotation of the lever about the pivot.

In order to provide for contact of individual boot heel holders or clamping means at different distances relative to the pivot, each holder or means will typically extend a different distance from the rotational center of the pivot. Given that each boot heel holder or clamping means may be shaped to improve engagement with a boot heel and will be preferably concave or comprising spaced apart surfaces, a convenient measure of the distance by which an individual boot heel holder or clamping means extends away from the pivot is to determine the minimum distance between the rotational center of the pivot and the surface on the boot heel holder or clamping means which contacts the boot heel. Thus, the surface will contain a notional point which is at the minimum distance to the pivot center and is closest to the pivot center. Preferably, the minimum distance for one boot heel holder will be about 0.95 to about 0.50 of the equivalent minimum distance for another boot heel holder or clamping means. Preferably, the aforementioned ratio will be about 0.90 to about 0.50, even more preferably about 0.85 to about 0.50, and even more preferably about 0.85 to about 0.60, although the specific ratio in any particular embodiment of this invention may fall anywhere within the aforementioned ranges.

An apparatus or lever of this invention will comprise a handle for actuating the lever, which handle will typically be sized and shaped for ease of manipulation by the user. The handle rests against the back of the boot when engaged on the boot and therefore may be shaped at such a resting surface to conform to the shape of the most rearward portion of a typical boot body. The lever will be "over-center" when either of a first and second heel holder or clamping means configured to contact the boot heel at different distances are engaged on the heel of the boot. This "over-center" aspect is provided for in part by selecting an appropriate position for the pivot in the lever relative to the boot contact surfaces of each boot holder or clamping means. However, the "over-center" aspect may be most ensured regardless of the particular boot with which the binding is used by positioning the boot contact surfaces of the heel holders or clamping means relative to the pivot center so that notional points on the contact surfaces of first and second boot holders or clamping means located on each surface at the minimum distance to the rotational center, in combination with the rotational center will represent a notional acute or right angled triangle. Thus, an angle represented by intersection of a first notional line representing the minimum distance for at least one boot holder or clamping means and a second notional line joining the points of minimal distance on the contact surfaces of each of the holders or clamping means will be 90° or less. In some embodiments, the angle may be about 85° or less or about 80° or less. In many embodiments, the angle will be at least 60°.

Heel tensioning levers of this invention may be of one piece or multi-piece construct. Some embodiments of an apparatus or heel tensioning lever of this invention may advantageously be constructed such that the handle and at least one heel holder or clamping means form an integral component while another heel holder or clamping means is provided on a separate, removable component that may be fixably attached to the integral component. Preferably in such an embodiment, the pivot will be located between the integral component and the removable component so that fastening of the removable component to the integral component may serve to retain a cable or bail at the pivot and disengagement of the removable component from the integral component will facilitate removal of the cable or bail from the pivot. Thus, this invention also provides a replacement component for a heel tensioning lever for a ski-touring binding, the lever comprising a handle, a plurality of boot heel holders, and a pivot for rotational engagement of the lever with a cable or bail of said binding, wherein at least one of the heel holders and the handle form an integral component, wherein the replacement component is configured to be removably fixed to said integral component to provide another of said heel holders on the lever, and to retain the bail or cable of the binding in rotational engagement with the tensioning lever at the pivot.

The pivot of an apparatus or heel tensioning lever of this invention may be any means for providing rotational movement of the lever relative to a cable or bail. Thus, the rotational means or pivot may be a through hole in the lever for receiving a cable or bail or may comprise an element such as a pin, rotational joint, or other such device adapted to be attached to a cable or bail or the end of a cable or bail so as to permit rotational movement of the lever relative to the cable or bail. In one embodiment of a removable component of this invention, the removable component comprises a curved wall, which when placed adjacent a similar curved wall in the integral component when the two components are joined, effectively forms a cylindrical or partially cylindrical through hole in the lever in which a cable or bail may be retained. Separation of the parts opens the through hole thereby permitting release of the cable or bail.

An apparatus or heel tensioning lever of this invention may be employed with any cable, bail, or cable/bail assembly of a touring binding or any touring binding comprising such a cable, bail, or cable/bail assembly which further comprises a ski binding toe piece and springs or other tensioning means for providing a constant tensioning force on the cable or bail. A cable is typically a longitudinal flexible element usually of cylindrical cross-section. A bail is typically a longitudinal element which is rigid or more rigid than a flexible cable, typically of a cylindrical cross-section. Many bindings employ a combination of a cable and bail. For example, a bail portion of the assembly may be employed at the heel of the boot and is engaged with a heel tensioning lever. Forward ends of the bail are joined to flexible cable elements which extend forwards to fixation points on the toe piece of the binding. However, it is possible for the binding to make use of only a bail assembly which is more rigid than a cable and will typically require the use of hinge elements for joining the bail at the toe piece. Springs or other resilient means for providing constant tension in a touring binding which makes use of this invention may be any such means employed for such purposes. One or more springs may be present in a single binding. The springs may operate under tension or compression and may be exposed or contained within cartridges as are typically used on touring bindings today such as the aforementioned TARGA™ models. The springs or other elastic means may be located within a cable/bail assembly, between a cable/bail assembly and a toe piece, beside the boot, underneath the boot or forward of cable/bail fixation or hinge points on the toe piece.

BRIEF DESCRIPTION OF THE DRAWINGS

FIG. 9A-FIG. F illustrate a sequence of events during which a user may engage and disengage a heel tensioning lever of this invention at the heel of a boot.

DETAILED DESCRIPTION OF THE INVENTION

The invention will now be described more particularly with reference to individual and preferred embodiments as illustrated in the attached drawings.

Figure 1:
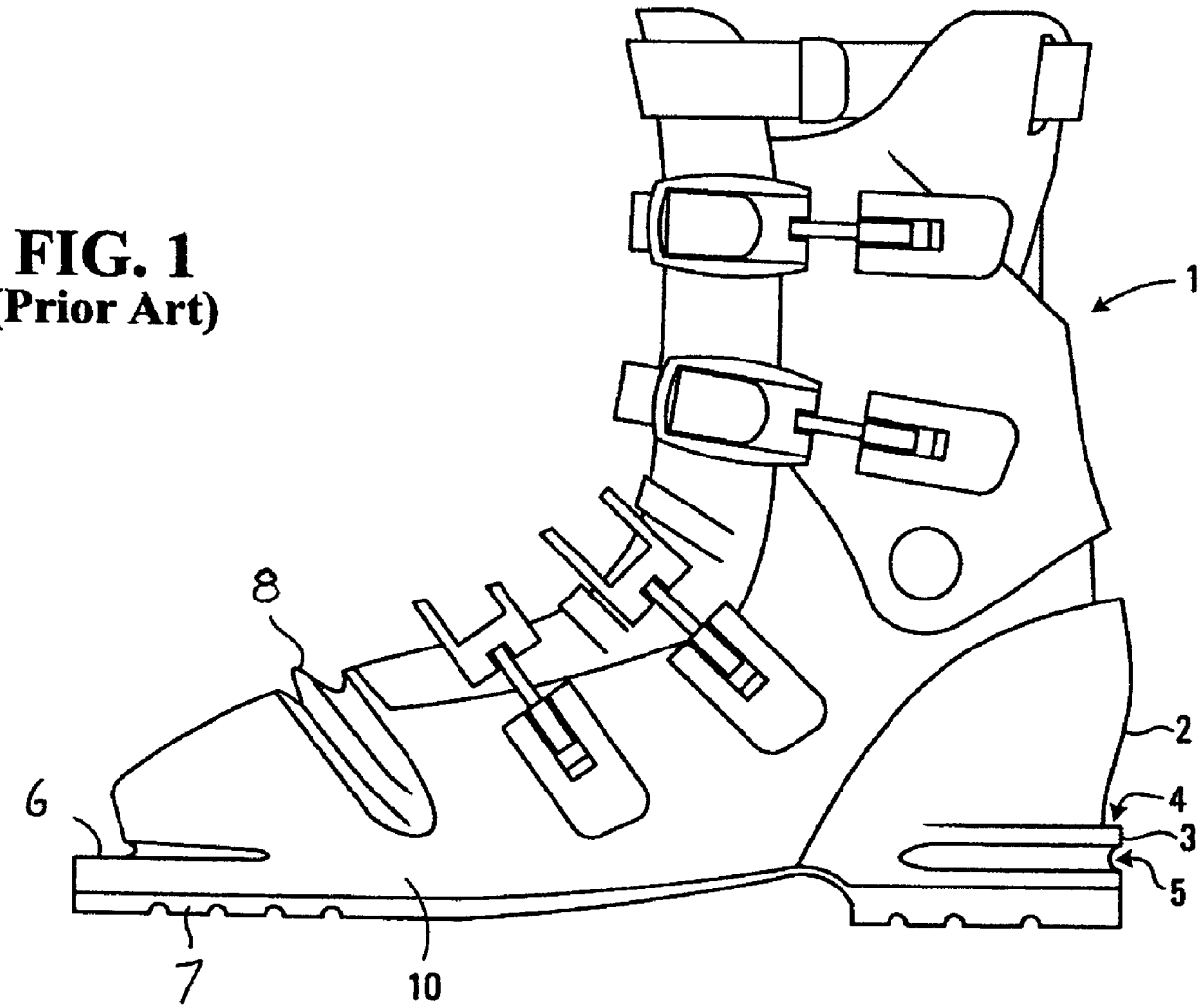
FIG. 1 (Prior Art)
FIG. 1 is a side view of a GARMONT™ touring ski boot containing features typical of plastic boots for telemark skiing.

A modem touring or telemark ski boot 1 made from synthetic plastic materials is illustrated in FIG. 1. In the boot heel region, welt 4 forms a ledge on top of heel counter 3 which faces towards boot upper 2. The heel counter further comprises lateral groove 5. Welt 4 and lateral groove 5 are representative of cable engagement means or features typical on ski boots used with touring bindings. The boot has a toe 6, sole 7, and compressible bellows 8 which permits forward and upward flexing of the boot near the region 10 of the ball of the foot.

Figure 2:
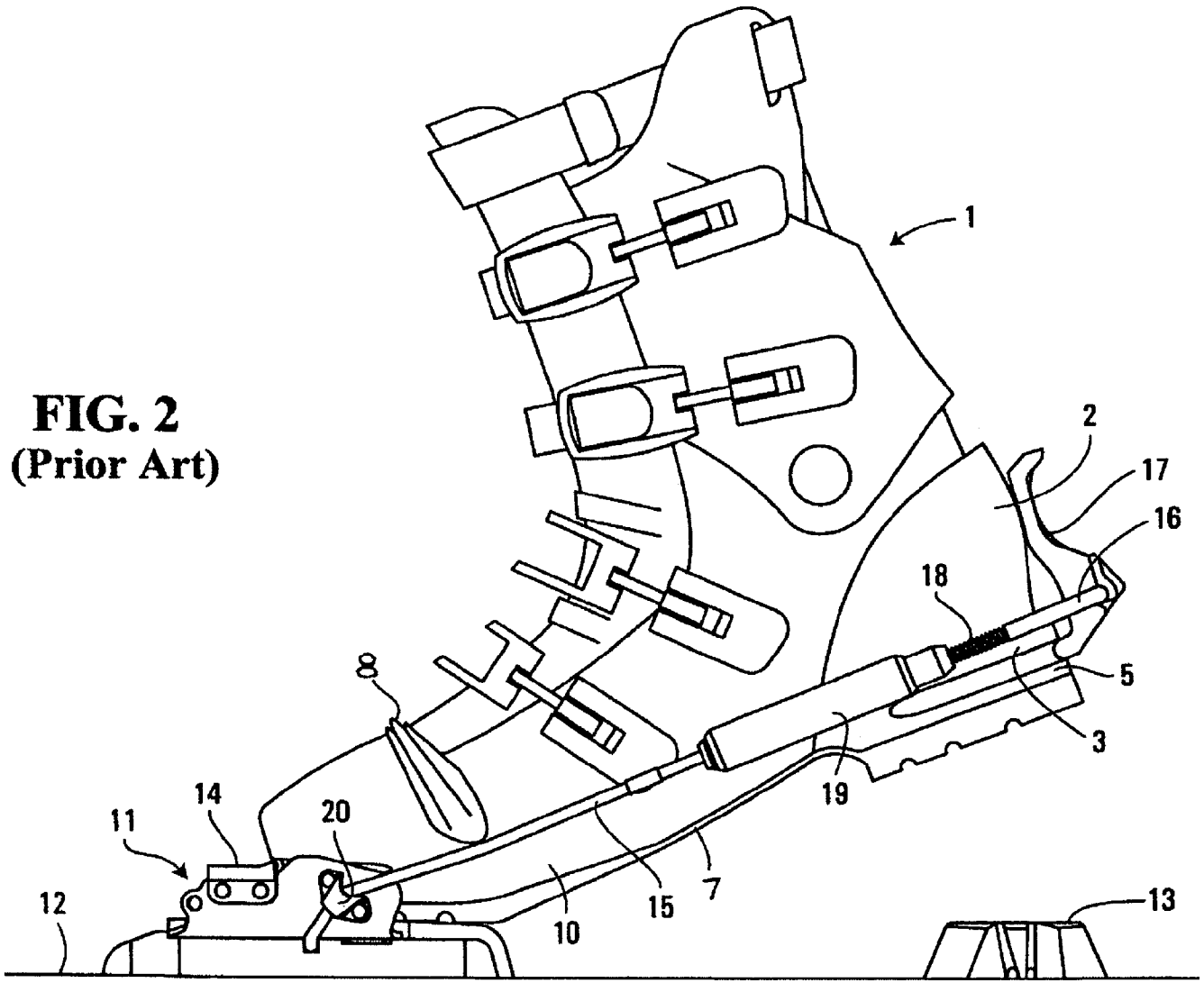
FIG. 2 (Prior Art)
FIG. 2 is a side view showing the boot of FIG. 1 in a TARGA™ touring binding (prior art). The binding is shown relative to the upper surface of a ski to which the binding components are fixed. The boot is shown in an elevated position typical of what is achieved during walking, climbing, and telemark turn maneuvers.

FIG. 2 illustrates the kind of boot shown in FIG. 1 placed in a prior art touring binding consisting of toe piece 11 which retains the toe of the boot against ski upper surface 12. Boot 1 is shown in an elevated position made possible by the design of binding 11 and the flexibility of compressible bellows 8 of boot 1. A touring binding may also comprise heel plate 13 which is typically a separate component fixed to ski surface 12 on which the heel of the boot will rest when the boot is not in an elevated position. Binding 11 permits upward and forward flexing of boot 1 because only the boot toe 7 (not visible in FIG. 2) is retained by binding 11 by means of bar or plate 14 which extends across the toe of the boot. Boot 1 is retained in binding toe piece 11 by tension directed forward of the boot which tension forces are delivered to the boot through a cable and bail assembly which in the TARGA™ model comprises flexible cable 15, bail 16, and heel tensioning lever 17. Bail 16 has end 18 adapted for coaxial engagement with compression spring cartridge 19 which is in coaxial engagement with flexible cable 15. The cable/bail assembly is fixed by cable guide 20 at the toe piece 11. In this model, flexibility of cable 15 at guide 20 provides for a hinge action at toe piece 11. Spring cartridge 19 contains an internal mechanism comprising a spring which is compressed when in use and cable 15 or bail 16 is engaged with the compression spring in such a manner as to deliver tension forces to the cable/bail assembly. Although the mechanism of cartridge 19 is not illustrated, a variety of such cartridges are available for use in touring bindings.

Figure 3:
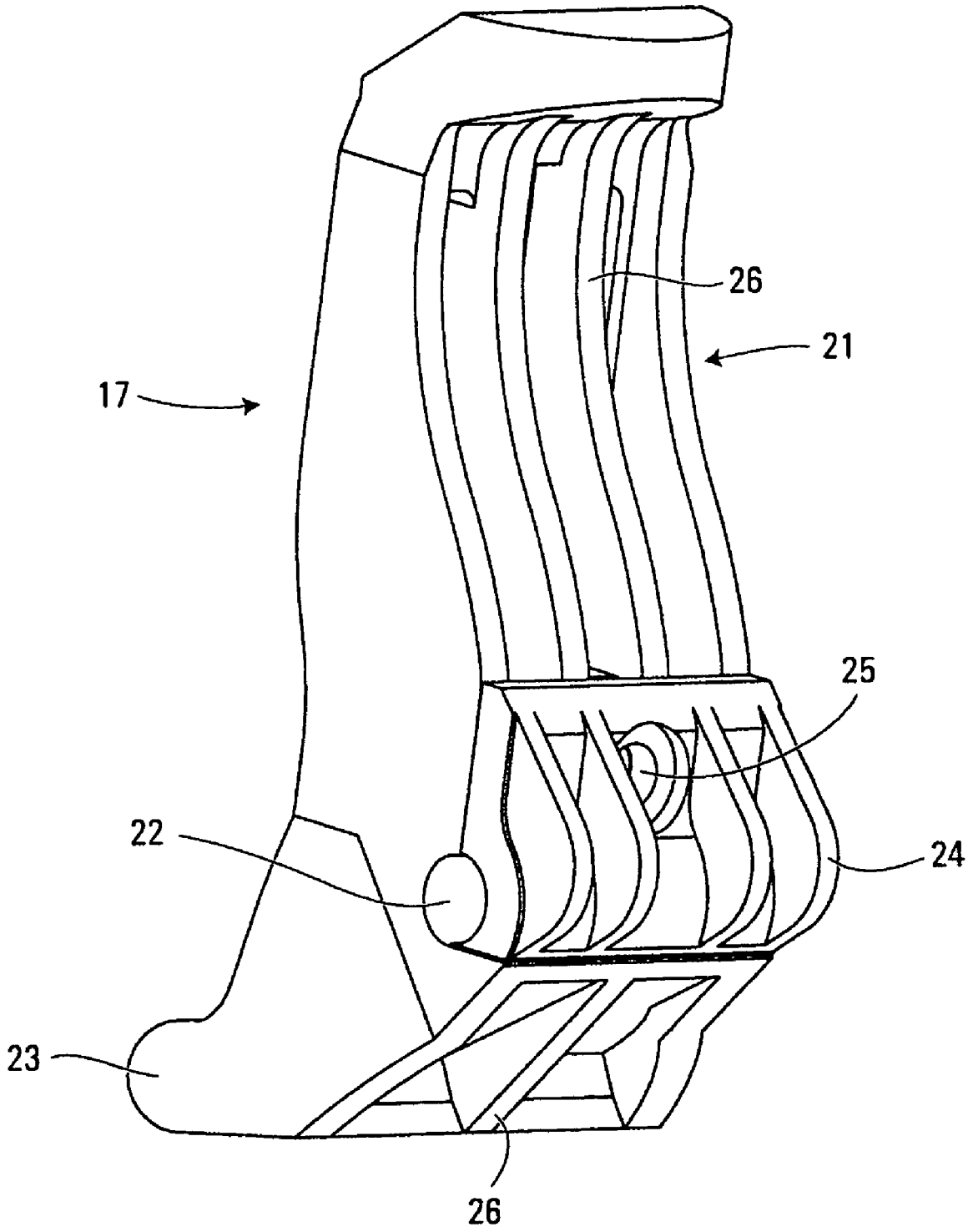
FIG. 3 (Prior Art)
FIG. 3 is an isometric view from the rear of the prior art heel tensioning lever shown in FIG. 2.

FIG. 3 illustrates the prior art heel tensioning lever 17 shown in FIG. 2 and used on the TARGA™ binding. Lever 17 comprises handle 21, pivot 22, and boot holder 23. In this embodiment, pivot 22 is a generally cylindrical through hole extending in a direction which will be transverse to the orientation of the lever relative to the boot when in use. To facilitate placement of a bail or cable of a touring binding within the through hole of pivot 22, lever 17 is further comprised of a removable component 24 which may be fixably attached by means of a suitable fastener placed in opening 25. A portion of the cylindrical walls of the through hole of pivot 22 is found on removable component 24. Thus, separation of component 24 from the lever makes it possible to remove a cable or bail retained within the through hole during use. Lever 17 comprises cut-away portions separated by ridges 26, which reduces the weight of the component while providing sufficient rigidity.

Figure 4:
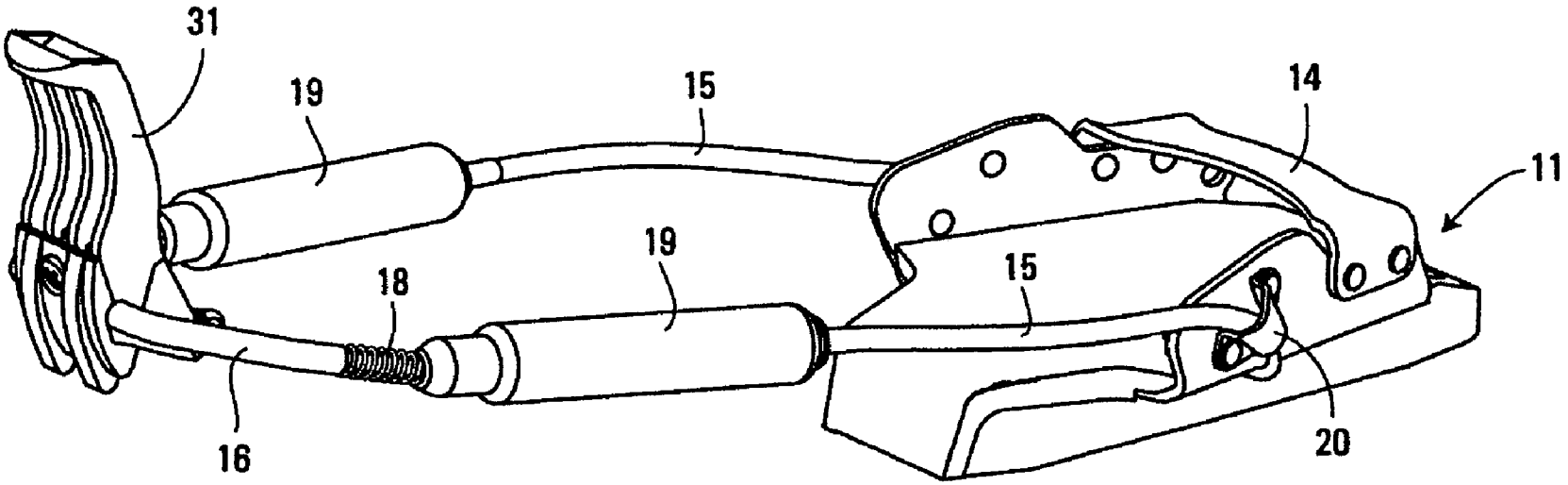
FIG. 4 is an isometric view of a TARGA™ touring binding (ski not shown) modified in accordance with this invention to include a heel tensioning lever of this invention.

FIG. 4 illustrates a TARGA™ binding such as is shown in FIG. 2 without a boot and modified to contain a heel tensioning lever 31 of this invention. Heel tensioning lever 31 is illustrated in combination with an entire touring binding for use on a single ski. Tensioning lever 31 may also be used in combination with any touring binding which includes a cable or bail extending around the heel of a boot.

Figure 5B:
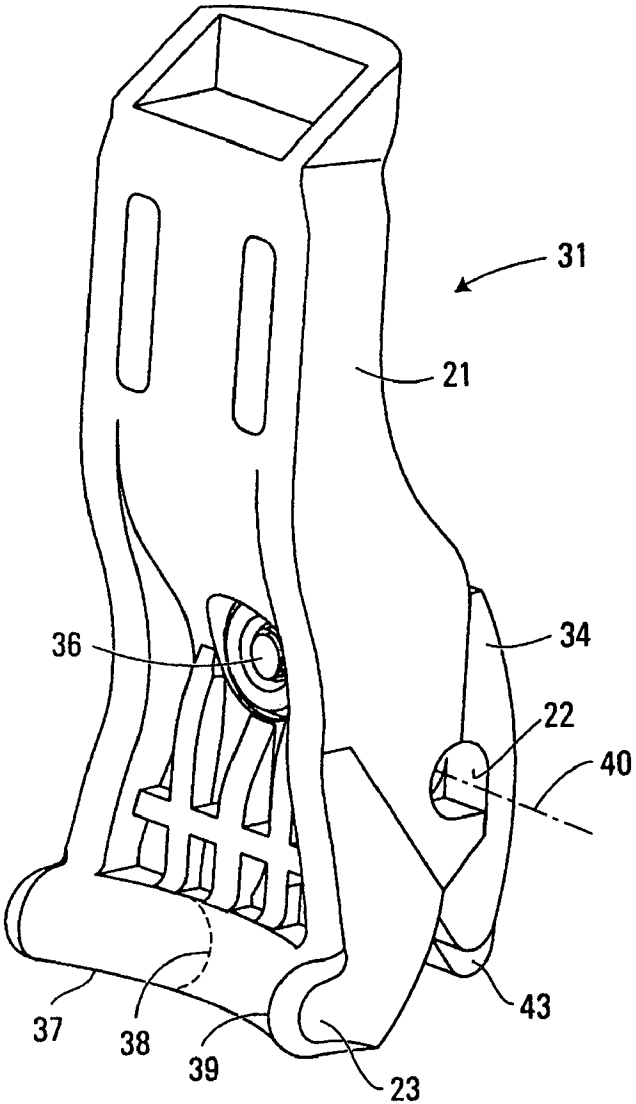
FIGS. 5A and 5B are isometric views of the heel tensioning lever illustrated in FIG. 4 with such views angled from the rear and the front of the heel tensioning lever, respectively.
Figure 5A:
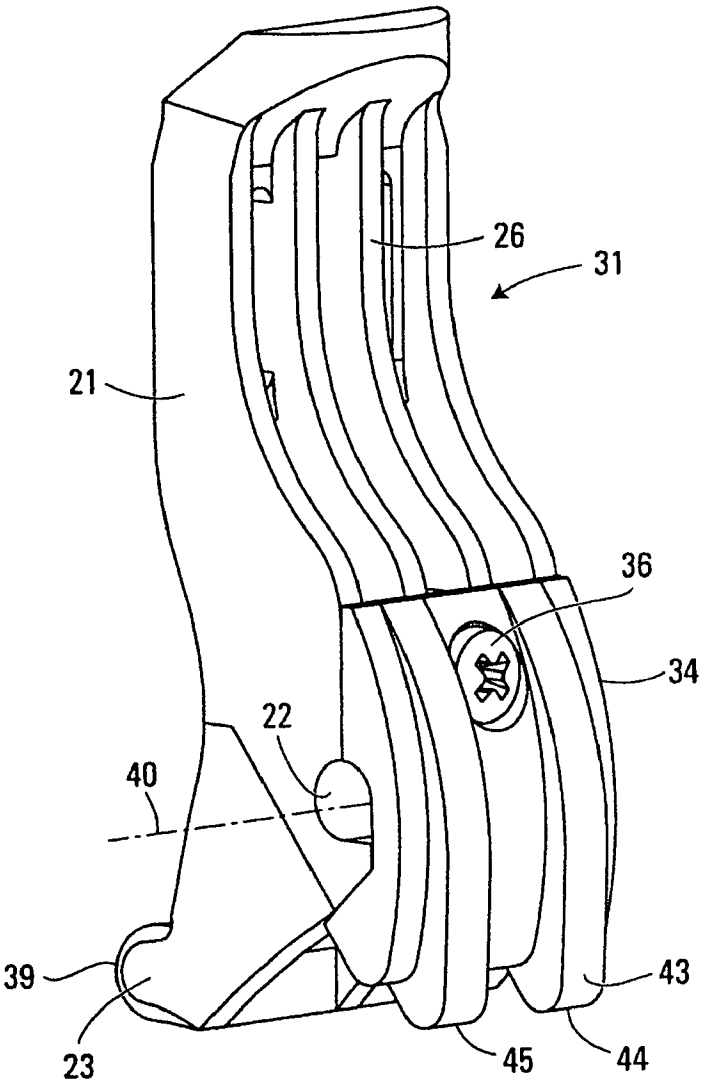

FIG. 5A and FIG. 5B illustrate the differences between heel tensioning lever 31 of this invention as compared to the prior art lever 17 shown in FIG. 3. Lever 31 comprises handle 21, pivot 22, and heel holder 23. In the lever of this invention, removable component 34 forms part of pivot 22 as was the case for component 24 in FIG. 3. Thus, use of removable component 34 continues to facilitate insertion or removal of a cable or bail at pivot 22. In FIGS. 5A & 5B, threaded fastener 36 is illustrated.

The side of lever 31 which is configured to face the rear and heel of the boot when in use is illustrated in FIG. 5B and the features shown therein are typical of tensioning levers used to date, including the prior art lever shown in FIG. 3. As is shown in FIG. 5A, first heel holder 23 is rounded at its terminus 39. Terminus 39 is preferably shaped to conform or fit to a cable engagement means on a ski boot such as welt 4 or lateral groove 5 shown in FIG. 1 and illustrated in engagement with lateral groove 5 in FIG. 2. Facing forwards, the lever has a concave surface 37 configured to generally conform to the rearward curvature of a boot heel counter. This provides greater stability while the lever is in clamping engagement with the heel of a boot. Since surface 37 is concave, only a point on a notional line 38 will be the point on surface 37 which is closest to rotational axis 40 of pivot 22. The minimum distance between rotational axis 40 and the closest point on notional line 38 represents the minimum distance between the center of pivot 22 and the contact surface defined by reference numbers 37 and 39 which contacts an engagement feature on the heel of a boot.

Lever 31 illustrated in FIGS. 5A and 5B comprises a second heel holder 43 which is provided as an extension. In this embodiment, heel holder 43 includes two, spaced apart members which provide spaced apart boot contact surfaces 44 and 45 which are adapted to contact the curved surface of a boot heel. In an alternate embodiment not illustrated, heel holder 43 may be shaped in a manner similar to heel holder 23 providing a concave boot contact surface, which may also be extended laterally as is the case with holder 23. In the illustrated embodiment, a minimum distance from rotational axis 40 to boot contact surfaces 44 or 45 of holder 43 may be measured in a straight line from axis 40 to the contact surface 44 or contact surface 45 since both are at the same distance from the pivot center. In the illustrated embodiment, the minimum distance from the rotational axis 40 to the boot contact surface for heel holder 43 provided on component 34 is less than the minimum distance for heel holder 23. When heel holder 43 is engaged with a feature on the heel of a ski boot, rotational axis 40 will be at a lesser distance from the boot heel than when the lever is engaged on the boot heel using holder 23. Thus, a lesser amount of tension will exist in the cablel/bail assembly of a binding when holder 43 is engaged as compared to holder 23.

Figure 6:
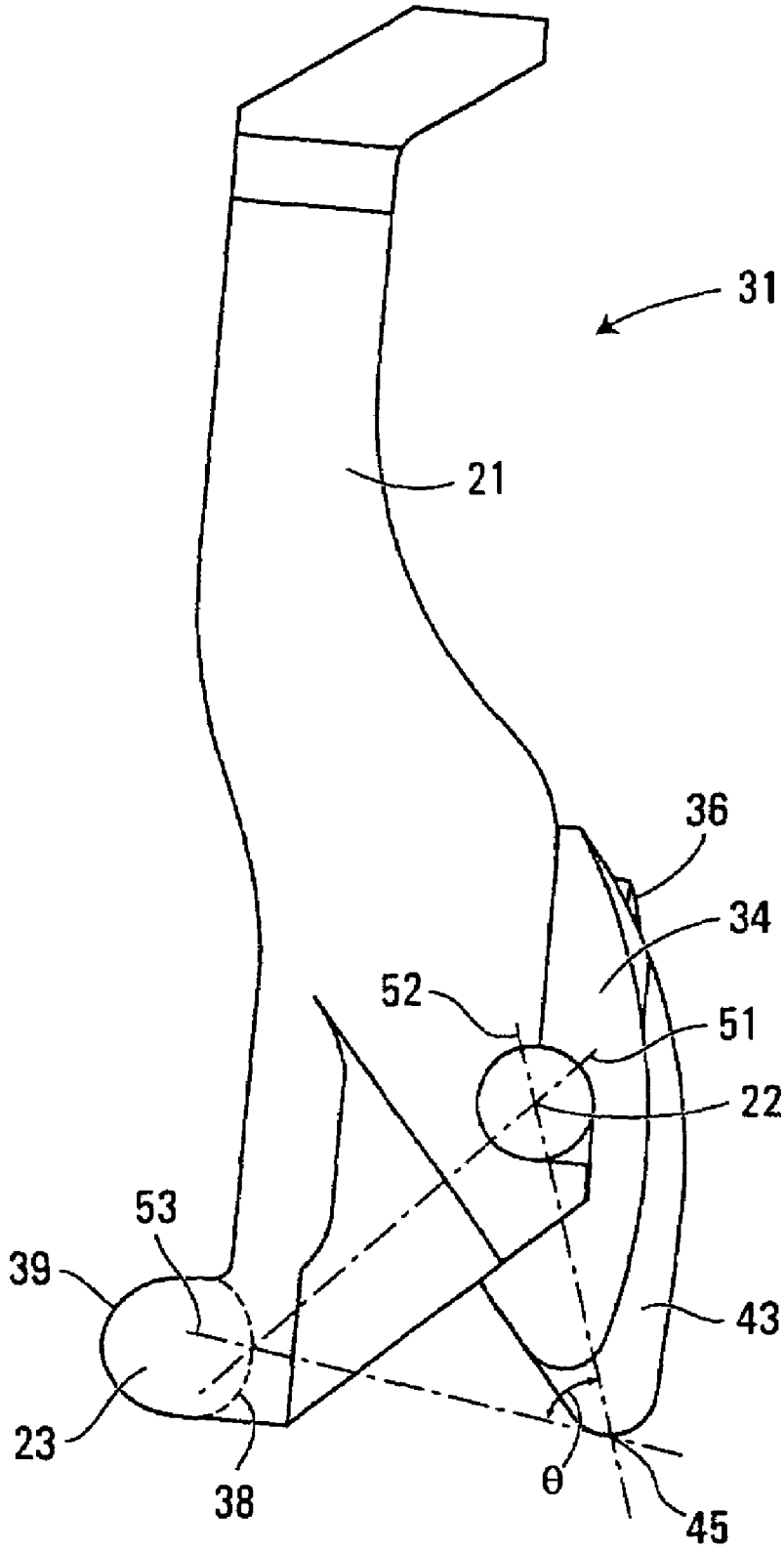
FIG. 6 is a side view of the heel tensioning lever illustrated in FIG. 4, FIG. 5A, and FIG. 5B.

FIG. 6 illustrates a side view of a tensioning lever of this invention. In side profile, holder 43 is generally wedge shaped terminating in contact surface 45 which has a curved terminal profile. This shape facilitates engagement with a cable engagement feature on a boot, particularly the lateral groove. This Figure also illustrates determination of minimum distances of holders 23 and 43 relative to the center of pivot 22 although not necessarily drawn to scale in the Figure. The closest point of the concave contact surface of holder 23 is on notional line 38. The minimum distance for the illustrated embodiment for holder 43 may be measured to contact surface 45 from the center of pivot 22. Imaginary lines 51, 52, and 53 shown in FIG. 6 follow these minimum distances and illustrate that points at the minimum distances on the contact surfaces of the two boot holders relative to the center of pivot 22 form an acute triangle in this embodiment with angle θ being less than 90°. Preferably, this angle with respect to the boot holder that is rearmost on the lever relative to the boot will not be greater than 90° and will preferably be less than 90° to help ensure that the lever is "over-center" when the rearmost boot holder is engaged with the heel of the boot.

Figure 7:
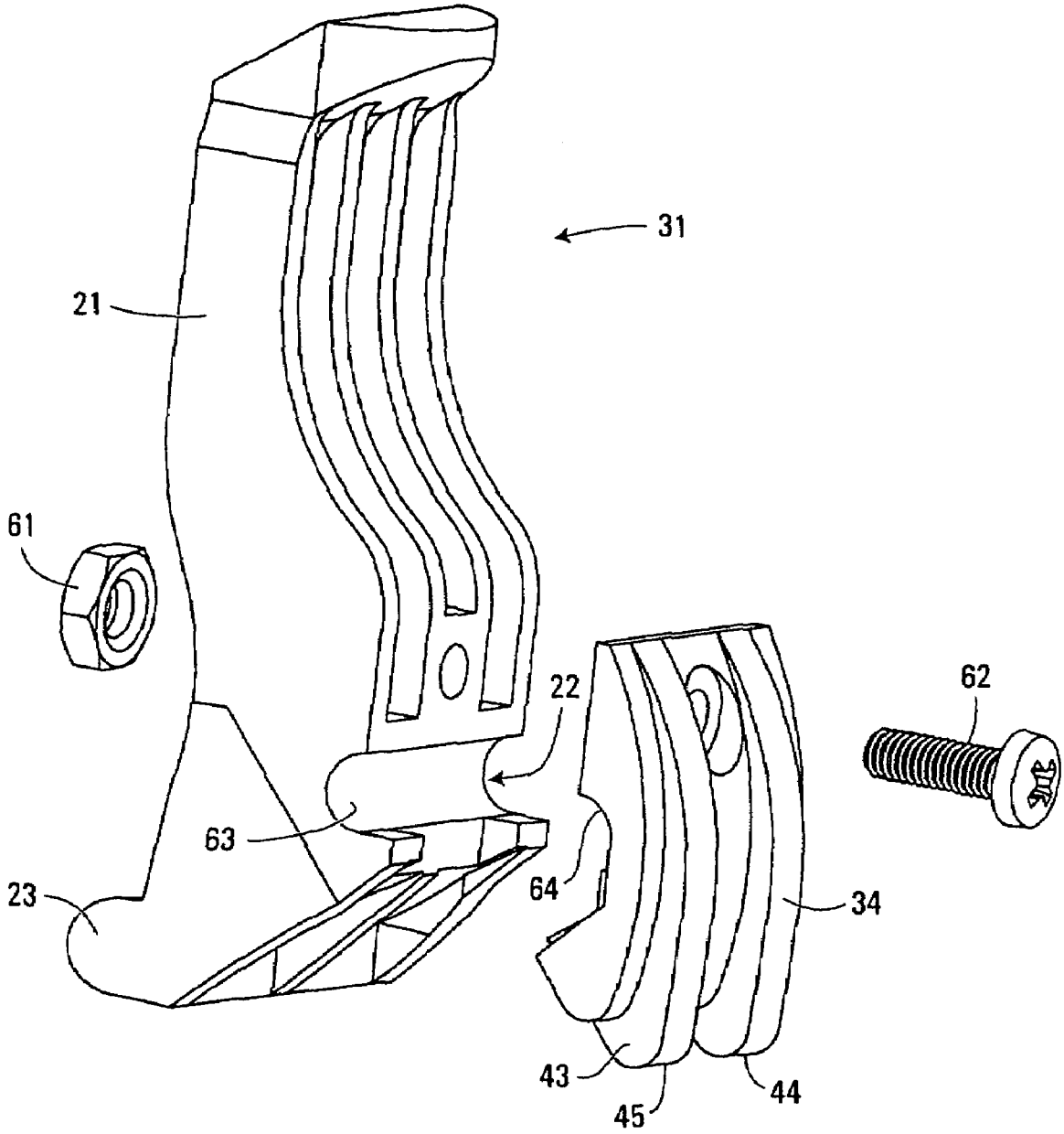
FIG. 7 is an exploded isometric view of the components of the heel tensioning lever illustrated in FIG. 4-FIG. 6.
Figure 8:
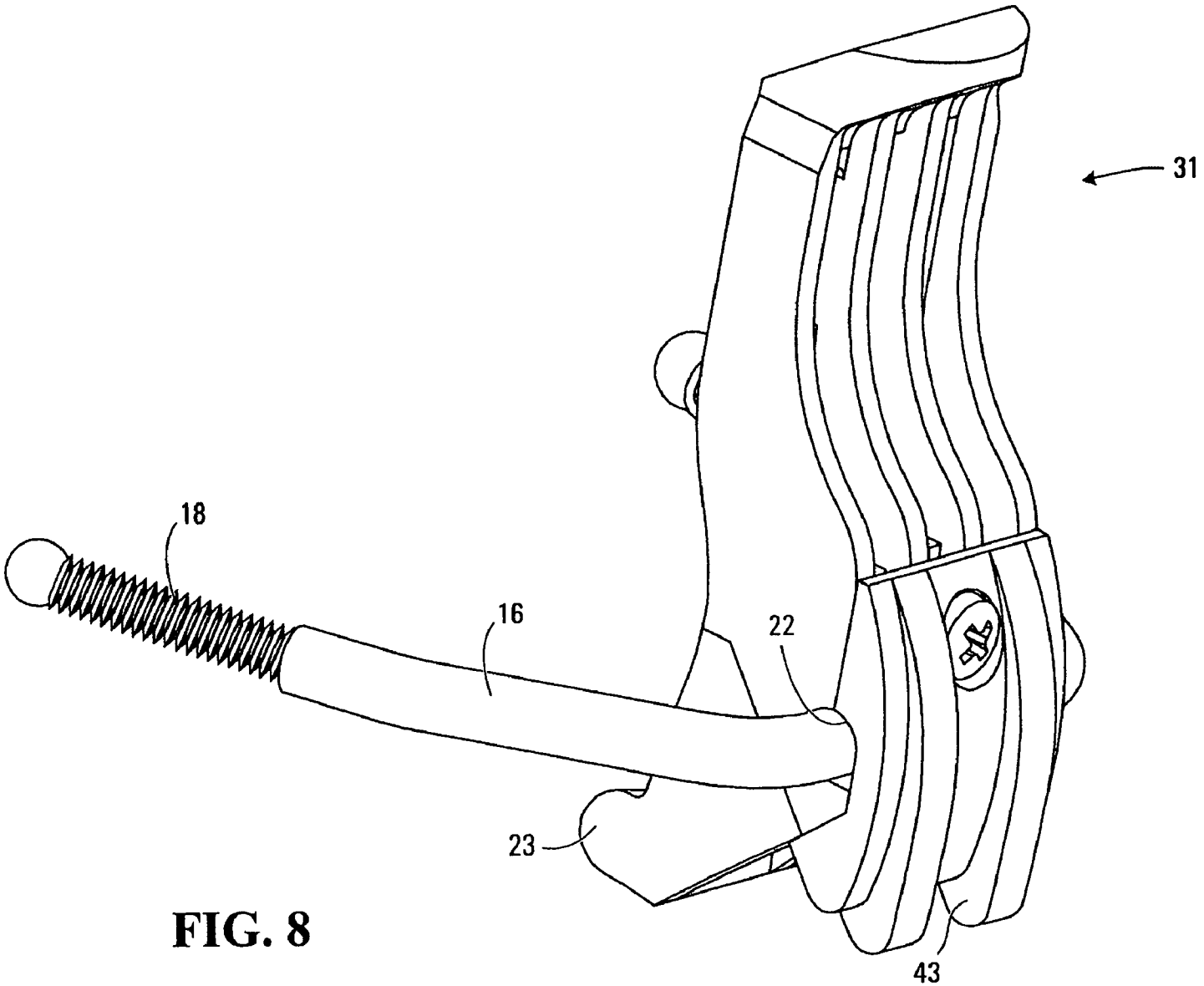
FIG. 8 is an isometric view of the heel lever illustrated in FIG. 4-FIG. 7 joined to a bail of a TARGA™ touring binding.

FIG. 7 illustrates the separate components of a preferred heel tensioning lever of this invention. Removable component 34 comprising heel holder 43 is shown detached from the remainder of the lever which is an integral component comprising handle 21 and heel holder 23. The removable component may be removably fixed to the integral component by means of a suitable fastener such as a threaded fastener including a screw or bolt. In the illustrated embodiment, bolt 62 and nut 61 are employed. Pivot 22 is essentially a cylindrical through hole through the intact lever. As is shown in FIG. 7, curved walls of this through hole 63 and 64 are found on the integral component and the removable component respectively. Joining of the removable component 34 to the integral component with a cable or bail placed therebetween serves the purpose of establishing rotational engagement of lever 31 with the cable or bail and retains the cable or bail on the lever.

Figure 9A:
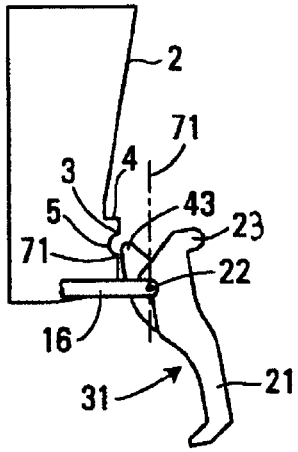
FIG. 9A-FIG. 9F are partial side views of the heel portion of a typical touring ski boot showing the heel counter region and a portion of the boot upper adjacent the heel. Also shown are side views of the heel tensioning lever illustrated in FIG. 4-FIG. 6 joined with a binding bail (partially shown).

The sequence of drawings shown in FIG. 9A-9F illustrates use of a lever of this invention. In each case, only the heel portion of the boot is shown and the same reference numerals as employed in FIG. 1 are used to illustrate features of the boot heel. In FIG. 9A, lever 31 is shown in a position just prior to engagement with the heel of a boot, termed the "disengaged" position. To engage the heel lever for touring mode shown in FIG. 9B (which facilitates walking and uphill travel), the user employs handle 21 to actuate the lever whereby the lever rotates upwards engaging boot holder 43 in lateral groove 5 of the boot. In order to do so, boot holder 43 must be forced over point 75 at the bottom of lateral groove 5 and while travelling, lever 31 will be displaced rearwards from the boot. Tension on the lever applied through bail 16 (partially shown) and spring components of the binding is negligible in the disengaged position and is higher when boot holder 43 is forced over point 75 on the boot heel. Continued movement in order that boot holder 43 engages with groove 5 then results in a lesser but significant tension thereby retaining the lever in clamping engagement with the boot heel in the walking or touring mode. A relative amount of tension in this position is illustrated by distance 100 between imaginary lines 71 and 72 in FIG. 9B with line 71 representing the position of the center of pivot 22 in the disengaged mode and line 72 representing displacement of the pivot center while the lever is in clamping engagement with the boot heel in the touring or walking mode. While the lever is being forced over point 75 in order to engage the touring mode, the amount of displacement would be greater than is shown between lines 71 and 72 in FIG. 9B. In the illustrated embodiment, boot holder 23 comes to rest against the rear part of boot upper 2 adjacent the heel and the lever is now in a stable "over-center" position with bail 16 being situated above the engagement of boot holder 43 in groove 5.

Figure 9B:
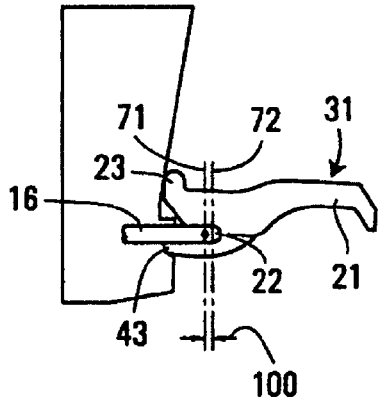
Figure 9C:
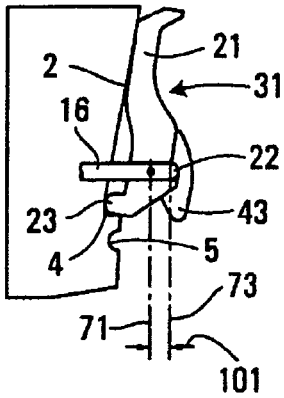

FIG. 9C and FIG. 9D-F illustrate alternate routes for changing the position of lever 31 from the touring or walking mode illustrated in FIG. 9B to ski modes where greater tension is provided to facilitate turning and other downhill or gliding maneuvers on the skis. The user may immediately proceed from the position shown in FIG. 9B to a first ski mode shown in FIG. 9C by continuing to rotate lever 31 upwards by actuating handle 21. This forces heel holder 23 downwards and against the boot so that it becomes in clamping engagement with welt 4. In this maneuver, heel holder 43 becomes disengaged from groove 5. Because heel holder 23 is situated at a greater distance from the center of pivot 22 than was the case for heel holder 43, the lever is displaced further to the rear and greater tension is exerted, as is illustrated by distance 101 between imaginary line 71 and line 73, which is greater than distance 100 in FIG. 9B.

Figure 9D:
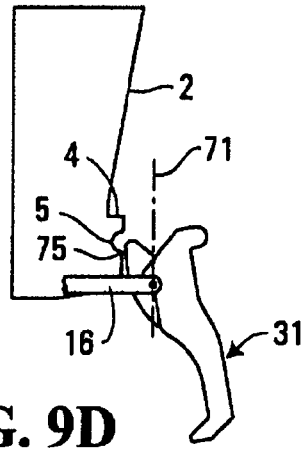
Figure 9E:
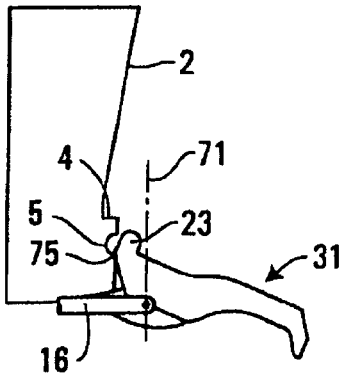
Figure 9F:
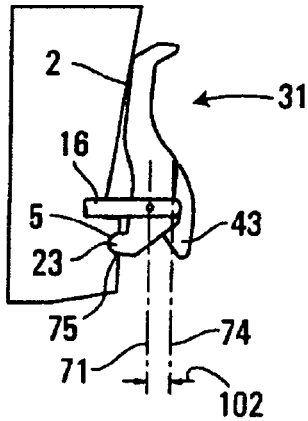

If the user prefers to not use the welt of the boot or if the boot does not include a welt, a second ski mode may be pursued through the sequence of events illustrated in FIG. 9D-9F. Here, the lever is moved from the tour mode position of FIG. 9B to the disengaged position as illustrated in FIG. 9D. The user then lifts the heel of the boot slightly upwards relative to lever 31 so that heel holder 23 becomes adjacent to groove 5 (FIG. 9E). The user then rotates lever 31 upwards thereby engaging heel holder 23 in groove 5 and a high level of tension is again provided and illustrated by distance 102 between imaginary line 71 and 74 in FIG. 9F.

The inventors have found that in some tests of a heel lever of this invention in a binding assembly as illustrated in FIG. 4 with a SCARPA™ telemark boot and standard TARGA™ spring cartridges, movement of the boot through a 30° range required as much as 30% less work in the touring mode. In this case, the boot holder minimum distance was approximately 0.75 as determined by the measurement method described above.

Although the foregoing invention has been described in some detail by way of illustration and example for purposes of clarity of understanding, it will be readily apparent to those of skill in the art in light of the teachings of this invention that changes and modification may be made thereto without departing from the spirit or scope of the appended claims.

What is claimed is:

1. An apparatus for tensioning a cable or bail of a ski-touring binding on a heel of a ski boot, the apparatus comprising a lever including a handle, first and second heel holders opposite the handle and a pivot between the handle and the heel holders for rotational engagement of the lever to the cable or bail, wherein in use, the lever has a first side that comprises: (i) a portion of the handle that contacts the ski boot and (ii) the first holder, while a second side of the lever comprising the second holder faces away from the ski boot, and wherein the first holder contacts the ski boot at a greater distance relative to the pivot than the second holder.

2. The apparatus of claim 1, further comprising a cable or bail of a ski-touring binding.

3. The apparatus of claim 1, further comprising a cable or bail and a toe piece of a ski-touring binding.

4. The apparatus of claim 1, wherein said first and second holders are shaped to fit a cable engagement feature of a ski boot heel.

5. The apparatus of claim 4, wherein one or both of said first and second holders comprise a concave surface for contacting the cable engagement feature.

6. The apparatus of claim 4, wherein one or both of said first and second holders comprise a plurality of spaced apart surfaces for contacting the cable engagement feature.

7. The apparatus of claim 1, wherein the first and second holders are spaced apart, each holder comprising a surface for contacting a cable engagement feature of a ski boot heel, the pivot having a rotational center, and wherein said contact surface of each holder has a point at a minimum distance to the rotational center, and wherein said minimum distance for the second holder is less than the minimum distance for the first holder.

8. The apparatus of claim 7, wherein the minimum distance for the second holder is about 0.95 to about 0.50 of the minimum distance for the first holder.

9. The apparatus of claim 7, wherein the minimum distance for the second holder is about 0.90 to about 0.50 of the minimum distance for the first holder.

10. The apparatus of claim 7, wherein the minimum distance for the second holder is about 0.85 to about 0.50 of the minimum distance for the first holder.

11. The apparatus of claim 7, wherein the minimum distance for the second holder is about 0.85 to about 0.6 of the minimum distance for the first holder.

12. The apparatus of claim 7, wherein each angle represented by intersection of each notional line representing the minimum distance for each of the holders and a notional line joining said points of minimal distance of the contact surfaces of each of the first and second holders is 90° or less.

13. The apparatus of claim 12, wherein each angle is about 85° or less.

14. The apparatus of claim 12, wherein each angle is about 80° or less.

15. The apparatus of claim 7, wherein the handle and the first holder are formed as an integral component and the second holder is part of a component removable from the integral component, and wherein the pivot rotational center is located between the integral component and the removable component.

16. The apparatus of claim 7, further comprising a cable or bail of a ski-touring binding.

17. The apparatus of claim 7, further comprising a cable or bail and a toe piece of a ski-touring binding.

18. The apparatus of claim 11, wherein each angle represented by intersection of each notional line representing the minimum distance for each of the holders and a notional line joining said points of minimal distance of the contact surfaces of each of the first and second holders is about 85° or less.

19. The apparatus of claim 18, wherein the handle and the first holder are formed as an integral component and the second holder is part of a component removable from the integral component, and wherein the pivot rotational center is located between the integral component and the removable component.

20. The apparatus of claim 18, further comprising a cable or bail of a ski-touring binding.

21. The apparatus of claim 18, further comprising a cable or bail and a toe piece of a ski-touring binding.

* * * * *